US011609509B2

(12) United States Patent
Sudoh

(10) Patent No.: US 11,609,509 B2
(45) Date of Patent: Mar. 21, 2023

(54) DEVELOPING APPARATUS AND IMAGE FORMING APPARATUS

(71) Applicant: SHARP KABUSHIKI KAISHA, Osaka (JP)

(72) Inventor: Teruyoshi Sudoh, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/403,015

(22) Filed: Aug. 16, 2021

(65) Prior Publication Data

US 2022/0057731 A1 Feb. 24, 2022

(30) Foreign Application Priority Data

Aug. 21, 2020 (JP) ..... JP2020-140186

(51) Int. Cl.
*G03G 15/08* (2006.01)

(52) U.S. Cl.
CPC ..... *G03G 15/0891* (2013.01); *G03G 15/0858* (2013.01); *G03G 15/0889* (2013.01)

(58) Field of Classification Search
CPC ..... G03G 15/0889; G03G 15/0858; G03G 15/0891
See application file for complete search history.

(56) References Cited

FOREIGN PATENT DOCUMENTS

JP 2005-292511 A 10/2005
JP 2017-173534 A 9/2017

*Primary Examiner* — Roy Y Yi
*Assistant Examiner* — Andrew V Do
(74) *Attorney, Agent, or Firm* — ScienBiziP, P.C.

(57) ABSTRACT

A developing apparatus includes: a developer tank that contains a developer; and conveyance members that convey the developer while agitating the developer. The conveyance members include a first screw and a second screw. The developer tank includes: a first storage chamber in which the first screw is provided; a second storage chamber in which the second screw is provided; a partition that separates the first storage chamber from the second storage chamber; and a flow area that opens the partition to flow the developer between the first storage chamber and the second storage chamber; a developer detection sensor that detects an amount of the developer thereof; a discharge port that discharges the developer; and a discharge guide that guides the developer to the discharge port. The developer detection sensor detects that the developer tank is full according to the amount of the developer.

4 Claims, 8 Drawing Sheets

DEVELOPING APPARATUS AND IMAGE FORMING APPARATUS

CROSS-REFERENCE TO RELATED APPLICATION

The present application claims priority from Japanese Patent Application Number 2020-140186, the content to which is hereby incorporated by reference into this application.

BACKGROUND OF THE INVENTION

1. Field of the Invention

One aspect of the present disclosure relates to a developing apparatus and an image forming apparatus, which include a developer tank.

2. Description of the Background Art

Conventionally, there has been known an electrophotographic image forming apparatus, and in such an image forming apparatus, a developing apparatus having a developer tank containing therein a developer is applied. The developing apparatus supplies a developer used for image formation, but inclination of the developer tank, etc., may cause uneven distribution of the developer within the developer tank. Therefore, a method for stabilizing the developer surface within the developer tank at an appropriate position has been proposed (see, for example, Japanese Unexamined Patent Application Publication No. 2005-292511).

Since the developer may overflow in the developing apparatus due to various factors, a method for detecting leakage of the developer has been proposed (see, for example, Japanese Unexamined Patent Application Publication 2017-173534).

SUMMARY OF THE INVENTION

The developing apparatus described in Japanese Patent Publication No. 2005-292511 has a developing container that contains a developer, a developer conveyance member that conveys the developer in the developing container, a developer discharge port that discharges the developer to the outside, a developer supply means that replenishes the developer, and a detection means that detects a developer surface of the developer in the developing container. a developer supply means for replenishing the developer, and a detection means for detecting the developer surface in the developing container.

In the above-described developing apparatus, however, the structure of the developing container and the operation of each part cause the developer to be unevenly distributed, and therefore, depending on the position where the detection means is provided, the change in the developer surface may not be correctly detected.

A developer device described in Japanese Patent Publication No. 2017-173534 controls the density of a developer by detecting the permeability of the developer with a magnetic sensor while conveying the developer contained in a housing, and includes a storage chamber which contains the developer overflowing from the housing, and a magnetic sensor detection The storage chamber is provided with a judgment means for judging that the developer has overflowed into the storage chamber according to the detection result of the magnetic sensor.

In the above-described developing apparatus, it is necessary to install a magnetic sensor at a position for detecting a developer in a storage chamber, and there is a problem that the position for installing the magnetic sensor is limited.

One aspect of the present disclosure has been made to solve the foregoing problems, and an object of the present disclosure is to provide a developing apparatus and an image forming apparatus, which are capable of accurately ascertaining that a developer tank has become full.

A developing apparatus according to one aspect of the present disclosure includes a developer tank that contains a developer, and conveyance members that convey the developer while agitating the developer in the developer tank, in which the conveyance members include a first screw and a second screw each having a helical blade provided on a periphery of a rotary shaft, the first screw and the second screw are disposed opposite to each other with their rotary shafts being parallel to each other, and rotate to circulate the developer in the developer tank, the developer tank includes a first storage chamber in which the first screw is provided, a second storage chamber in which the second screw is provided, a partition that separates the first storage chamber from the second storage chamber, and a flow area provided at an end as viewed in an axial direction along the rotary shaft, the flow area opening the partition to flow the developer between the first storage chamber and the second storage chamber, a developer detection sensor that detects an amount of the developer at its installation position, a discharge port that discharges the developer, and a discharge guide that guides the developer to the discharge port, and when a direction to which the developer is circulated in the developer tank is referred to as a circulation direction, the developer detection sensor is provided at a position before the flow area as viewed in the circulation direction and overlapping the partition as viewed in the axial direction, and detects that the developer tank is full according to the amount of the developer.

In the developing apparatus according to one aspect of the present invention, the developer detection sensor may be provided facing the upstream side in the rotation direction of the helical blades in the region above the rotation axis.

A developing apparatus according to one aspect of the present disclosure includes a developer tank that contains a developer, and conveyance members that convey the developer while agitating the developer in the developer tank, in which the conveyance members include a first screw and a second screw each having a helical blade provided on a periphery of a rotary shaft, the first screw and the second screw are disposed opposite to each other with their rotary shafts being parallel to each other, and rotate to circulate the developer in the developer tank, the developer tank includes a first storage chamber in which the first screw is provided, a second storage chamber in which the second screw is provided, a partition that separates the first storage chamber from the second storage chamber, and a flow area provided at an end as viewed in an axial direction along the rotary shaft, the flow area opening the partition to flow the developer between the first storage chamber and the second storage chamber, a developer detection sensor that detects an amount of the developer at its installation position, a discharge port that discharges the developer, and a discharge guide that guides the developer to the discharge port, and when a direction to which the developer is circulated in the developer tank is referred to as a circulation direction, the developer detection sensor detects the amount of the developer discharged from the discharge port, and detects that the developer tank is full when a period that the developer is not discharged is a predetermined time or longer during driving of the conveyance member.

The developing apparatus according to one aspect of the present disclosure may further includes an enclosure to which the developer tank is mounted, in which the developer tank is configured to be detachable from the enclosure, the enclosure has an enclosure discharge section connected to the discharge port, the developer detection sensor is provided in the enclosure discharge section.

In the developing apparatus according to one aspect of the present invention, the developer detection sensor may be provided in the discharge guide, and detects an amount of the developer discharged from the discharge port according to an amount of the developer in the discharge guide.

The developing apparatus according to one aspect of the present disclosure includes a discharge screw that extends from the first screw or the second screw, and is provided in the discharge guide, in which the discharge screw feeds the developer in the discharge guide from the discharge port to the first storage chamber or the second storage chamber when the conveyance member is circulating the developer in the circulation direction, when the developer detection sensor detects that the developer tank is full, the discharge screw is reversely rotated.

An image forming apparatus according to one aspect of the present invention is characterized in that it is equipped with a developing apparatus according to the present invention.

According to one aspect of the present disclosure, by providing a developer detection sensor at a point where the variation is large, it is possible to accurately ascertain that the developer tank has become full when the amount of developer in the developer tank increases. Furthermore, by carefully observing the developer to be discharged during driving, it is possible to accurately ascertain that the developer tank has become full.

DESCRIPTION OF THE PREFERRED EMBODIMENTS

First Embodiment

Hereinafter, an image forming apparatus according to a first embodiment of the present disclosure will be described with reference to the drawings.

Figure 1:
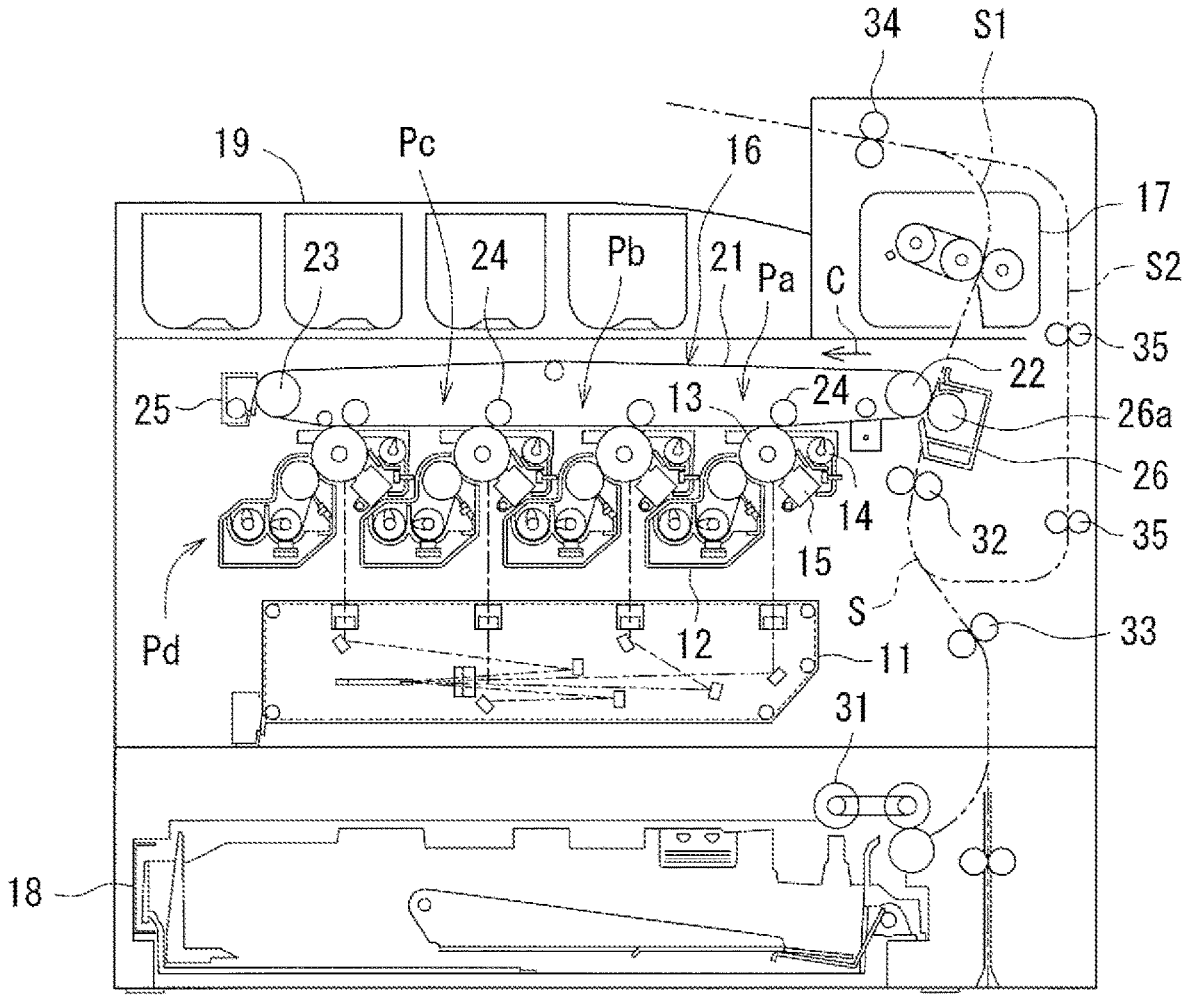
FIG. 1 is a schematic side view of an image forming apparatus according to a first embodiment of the present disclosure.

FIG. 1 is a schematic side view of the image forming apparatus according to the first embodiment of the present disclosure.

An image forming apparatus 1 according to the first embodiment of the present disclosure includes an exposure device 11, a developing apparatus 12, a photosensitive drum 13, a cleaner device 14, a charger 15, an intermediate transfer belt device 16, a fixing device 17, a paper feed tray 18, a paper output tray 19, and a paper conveyance path S, and forms a multicolor image or a monochromatic image on a predetermined paper sheet in response to image data transmitted from outside.

The image data handled by the image forming apparatus 1 is according to a color image using black (K), cyan (C), magenta (M), and yellow (Y) colors. Four sets of the developing apparatus 12, the photosensitive drum 13, the charger 15, and the cleaner device 14 are provided so as to respectively form four types of latent images corresponding to the respective colors: black; cyan; magenta; and yellow, and constitute four imaging stations Pa, Pb, Pc and Pd.

The photosensitive drum 13 is disposed at approximately the center of the image forming apparatus 1. The charger 15 uniformly charges the surface of the photosensitive drum 13 to a predetermined potential. The exposure device 11 exposes the surface of the photosensitive drum 13 to form an electrostatic latent image. The developing apparatus 12 develops an electrostatic latent image on the surface of the photosensitive drum 13 to form a toner image on the surface of the photosensitive drum 13. Through the series of operations described above, a toner image of each color is formed on the surface of each photosensitive drum 13. The cleaner device 14 removes and collects the residual toner on the surface of the photosensitive drum 13 after development and image transfer. The structure of the developing apparatus 12 will be described in detail with reference to FIGS. 2 to 4 described below.

The intermediate transfer belt device 16 is disposed on the upper side of the photosensitive drum 13 and includes an intermediate transfer belt 21, an intermediate transfer belt drive roller 22, an intermediate transfer belt driven roller 23, an intermediate transfer roller 24, and an intermediate transfer belt cleaning device 25. There are four intermediate transfer rollers 24 which correspond to the image stations for the respective YMCK colors.

The intermediate transfer belt drive roller 22, the intermediate transfer belt driven roller 23, and the intermediate transfer roller 24 tension the intermediate transfer belt 21 and move the surface of the intermediate transfer belt 21 in a predetermined direction (in the direction of arrow C in the figure).

The intermediate transfer belt 21 circularly moves in the direction of arrow C, residual toner is removed therefrom and collected by the intermediate transfer belt cleaning device 25, and the toner images of the respective colors formed on the surfaces of the respective photosensitive drums 13 are sequentially transferred and superimposed to form a color toner image on the surface of the intermediate transfer belt 21.

The image forming apparatus 1 further includes a secondary transfer device 26 including a transfer roller 26*a*. The transfer roller 26*a* has a nip area formed between it and the intermediate transfer belt 21, and conveys the paper that has been conveyed through the paper conveyance path S by sandwiching it in the nip area. When the paper passes through the nip area, the toner image on the surface of the intermediate transfer belt 21 is transferred.

The paper feed tray 18 is a tray for accumulating paper to be used for image formation, and is provided on the lower side of the exposure device 11. The paper output tray 19 is provided on the upper side of the image forming apparatus 1 and is a tray for placing the image formed paper.

The paper conveyance path S has a main path S1 provided in an S-shape, and a reversing path S2 which branches and rejoins in a midway of the main path S1. Along the main path S1, a pickup roller 31, a pre-resist roller 33, a resist roller 32, a secondary transfer device 26, the fixing device 17, and a paper output roller 34 are disposed. The reversing path S2 branches off from between the fixing device 17 and the paper output roller 34 and rejoins between the pre-resist roller 33 and the resist roller 32 via a plurality of transport rollers 35.

The pickup roller 31 is provided near the end of the paper feed tray 18 and is an intake roller for supplying a paper sheet one by one from the paper feed tray 18 to the paper conveyance path S. The resist roller 32 temporarily holds the paper sheet being conveyed from the paper feed tray 18, and conveys the paper sheet to the transfer roller 26*a* at a timing at which the leading edge of the toner image on the photosensitive drum 13 aligns with the leading edge of the paper sheet. The pre-resist roller 33 is a small roller for facilitating and assisting the transport of the paper.

The fixing device 17 is a belt fusing system, and a fusing belt 44 is wound around a fusing roller 41 and a heating roller 43. In the fixing device 17, the pressure roller 42 is pressed against the fusing roller 41 via the fusing belt 44. The fixing device 17 receives the paper on which the unfixed toner image has been formed, and conveys the paper between the fusing belt 44 and the pressure roller 42. The paper after fusing is discharged onto the paper output tray 19 by the paper output roller 34.

When image formation is performed on the back side as well as the front side of the paper, the paper is conveyed in the reverse direction from the paper output roller 34 to the reversing path S2, the front and back sides of the paper are reversed, the paper is led again to the resist roller 32, image formation is performed on the back side in the same manner as on the front side, and the paper is carried out to the paper output tray 19.

Next, the structure of the developing apparatus 12 will be described with reference to FIGS. 2 to 4.

Figure 2:
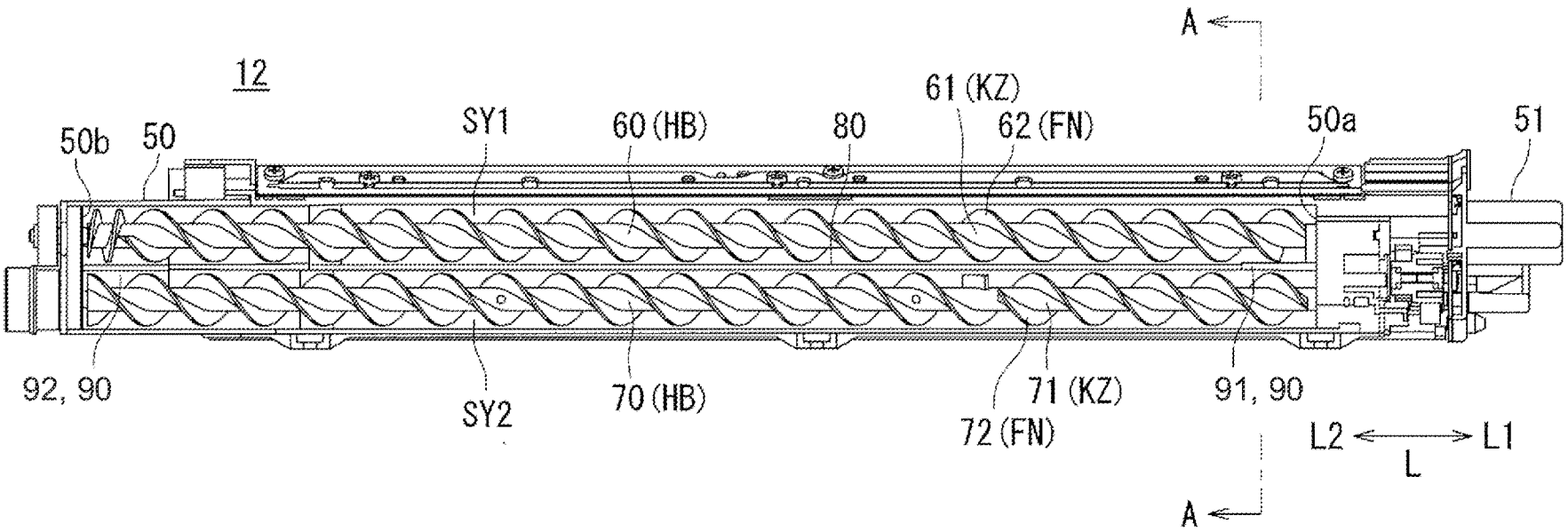
FIG. 2 is a top cross-sectional view showing a cross-section of the developing apparatus in a top view.
Figure 3:
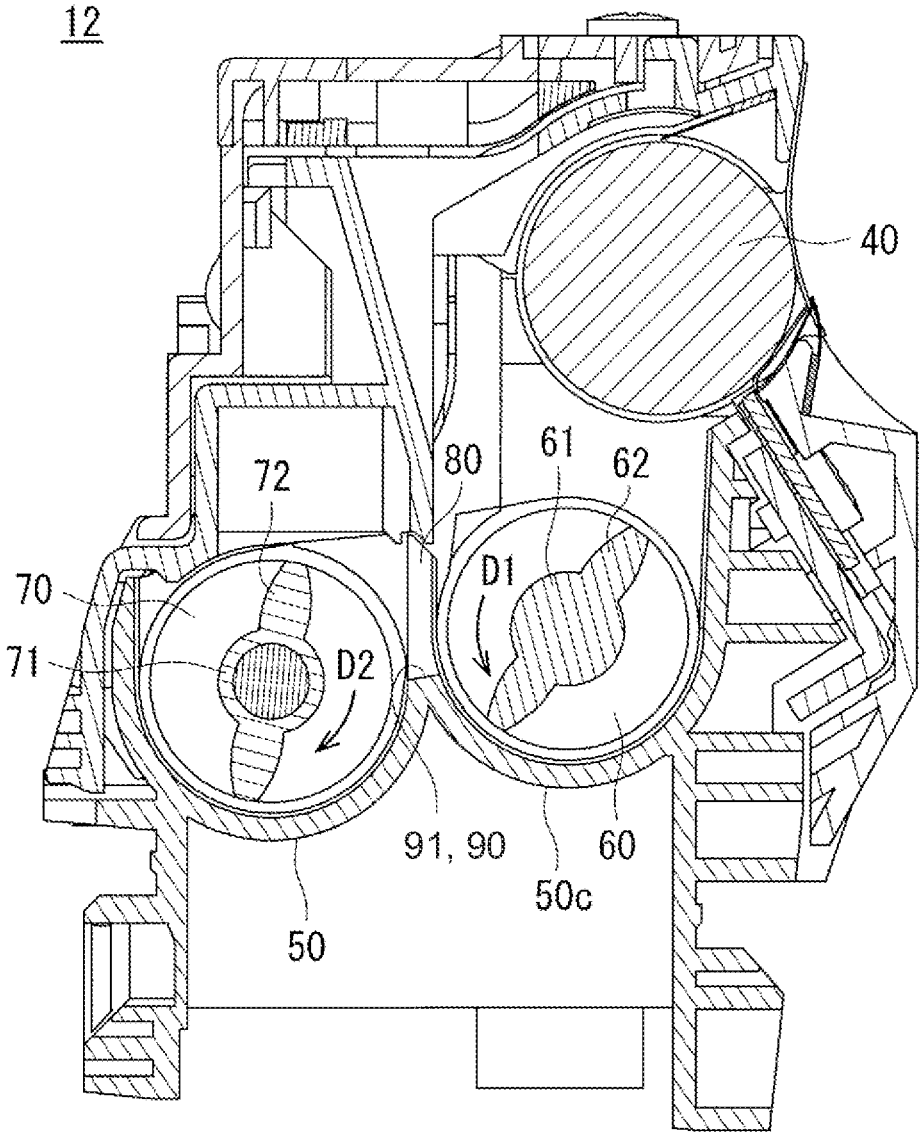
FIG. 3 is a side cross-sectional view showing the cross-section at arrow mark A-A in FIG. 2.

FIG. 2 is a top cross-sectional view showing a cross-section of the developing apparatus in a top view, and FIG. 3 is a side cross-sectional view showing a cross-section at arrow mark A-A in FIG. 2. In FIG. 2, the developing roller 40 of the developing apparatus 12 is shown without the developing roller 40 for ease of viewing the drawing, and the hatching is omitted.

The developing apparatus 12 mainly composed of a developing roller 40, a developer tank 50, and conveyance members HB. In addition to the above-described items, the developing apparatus 12 may be provided with a member that reinforces each part and a member that supports the developing apparatus 12 to be freely attached to the image forming apparatus 1.

The developing roller 40 is provided in contact with the photosensitive drum 13 and supplies toner to the photosensitive drum 13. In the present embodiment, the developing roller 40 is disposed above the developer tank 50. However, this is not limitative, and the developing roller 40 needs to be provided to face a portion of the developer tank 50 from which toner is supplied to the outside.

The developer tank 50 is a container having in its interior a cavity, and contains therein a developer. The developer may be, for example, a two-component developer that contains a toner and a magnetic carrier. The conveyance members HB, which are incorporated in the developer tank 50, are a first screw 60 and a second screw 70, each having a helical blade FN on the periphery of a rotary shaft KZ. The first screw 60 and the second screw 70 are disposed opposite each other with their rotary shafts KZ being parallel to each other, and rotate to circulate the developer in the developer tank 50.

The developer tank 50 has a first storage chamber SY1 incorporating therein the first screw 60 and a second storage chamber SY2 incorporating therein the second screw 70. The first storage chamber SY1 and the second storage chamber SY2 are separated by a partition 80. In the following, in order to distinguish the respective parts of the first screw 60 and the second screw 70, the rotary shaft KZ and the helical blade FN of the first screw 60 may be referred to as a first shaft 61 and a first blade 62, and the rotary shaft KZ and the helical blade FN of the second screw 70 may be referred to as a second shaft 71 and a second blade 72. Concerning the axial directions L along the rotary shaft KZ, the direction toward one end of the developer tank (developer tank first end 50*a*) may be referred to as a first axial direction L1 (the right direction as viewed in FIG. 2), and the direction toward the other end of the developer tank 50 (a developer tank second end 50*b*) may be referred to as a second axial direction L2 (the left direction as viewed in FIG. 2).

The partition 80 is open at a portion corresponding to each end in the axial direction L of the first storage chamber SY1 and the second storage chamber SY2. A flow area 90 through which the developer is allowed to flow between the first storage chamber SY1 and the second storage chamber SY2. For the purpose of explanation, the flow area 90 provided on a developer tank first end 50*a* side is hereinafter referred to as a first flow area 91, while the flow area 90 provided on the developer tank second end 50*b* side is referred to as a second flow area 92.

With the developer tank 50 being mounted on the image forming apparatus 1, the bottom surface of the developer tank 50 (a tank bottom surface 50*c*) may be inclined so that the first storage chamber SY1 and the second storage chamber SY2 are different in height in a manner in which the first storage chamber SY1 side is higher than the second storage chamber SY2 side.

In the portion corresponding to the distribution area, the openings in the partition 80 are located higher than the tank bottom surface 50*c*. In other words, in the distribution area, the partition 80 is lowered and a gap is provided so that the partition 80 is not blocked to the upper surface, so that the developer is distributed over the lowered partition 80. In the developer tank 50, the tank bottom surface 50*c* may be curved so that a gap to the helical blades FN is reduced.

The developer tank 50 includes a discharge guide 51 extending from the developer tank first end 50*a* toward the outside. The discharge guide 51 will be described in detail with reference to FIG. 4 below.

In the present embodiment, the first screw 60 rotates (in the direction of arrow D1) so as to move the developer from above to below on the side facing the partition 80, and the second screw 70 rotates (in the direction of arrow D2) so as to move the developer from above to below on the side facing the partition 80.

As described above, the developer is conveyed so as to circulate in the developer tank 50. The direction in which the developer is circulated (circulation direction) varies properly according to a part in the developer tank 50.

Specifically, the circulation direction in the first storage chamber SY1 is a direction from the developer tank first end 50*a* to the developer tank second end 50*b* (a second axial direction L2). The developer conveyed to the developer tank second end 50*b* moves to the second storage chamber SY2 through the second flow area 92. That is, the circulation direction near the developer tank second end 50*b* is a direction from the first storage chamber SY1 to the second storage chamber SY2 (the downward direction as viewed in FIG. 2).

The circulation direction in the second storage chamber SY2 is a direction from the developer tank second end 50*b* to the developer tank first end 50*a* (a first axial direction L1). The developer conveyed to the developer tank first end 50*a* moves to the first storage chamber SY1 through the first flow area 91. That is, the circulation direction near the developer tank first end 50*a* is a direction from the second storage chamber SY2 to the first storage chamber SY1 (the upward direction as viewed in FIG. 2).

Figure 4:
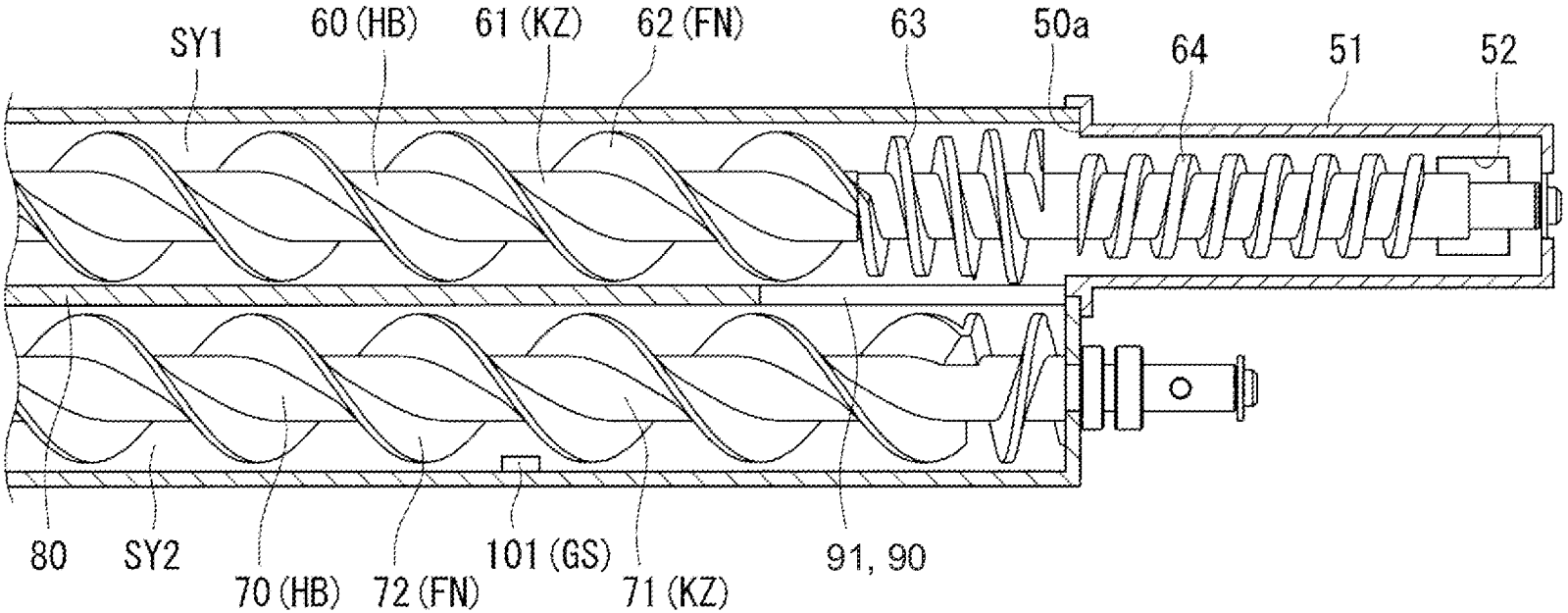
FIG. 4 is a schematic cross-sectional view in the vicinity of the discharge guide of the developing apparatus.

FIG. 4 is a schematic cross-sectional view of the discharge guide vicinity of the developing apparatus. In FIG. 4, for ease of viewing the drawing, the structure of the developer tank 50 is illustrated schematically, and recesses and projections are omitted.

The discharge guide 51, which is a pipe extended from the first storage chamber SY1 side of the developer tank first end 50*a*, has in its interior a cavity, and has at the tip a discharge port 52 that is open downward. In other words, the interior of the discharge guide 51 is connected to the first storage chamber SY1, and some developer flows therein from the first storage chamber SY1.

The first screw 60 extends outwardly from the developer tank first end 50*a*, and its end is supported at the tip of the discharge guide 51. At the end on the developer tank first end 50*a* side, the first screw 60 is provided with a flow rate regulating blade 63 and a discharge screw 64 instead of the first blade 62. Specifically, the flow rate regulating blade 63 is provided in the first storage chamber SY1 at a position facing the first flow area 91, and has a blade pitch which is denser than that of the first blade 62. The discharge screw 64, which is provided in the discharge guide 51, is a helical blade wound in the opposite direction to the first blade 62. The discharge screw 64 feeds the developer within the discharge guide 51 to the first storage chamber SY1 through the discharge port 52 during the circulation operation in which the first screw 60 circulates the developer in the circulation direction.

The discharge guide 51 operates to send the developer to the first storage chamber SY1 in the circulation operation, but the flow of the developer sent from the first storage chamber SY1 by the first blade 62 causes some of the developer to go toward the discharge port 52 little by little, and a small amount of the developer is discharged from the discharge port 52.

A developer detection sensor GS that detects the amount of developer at its installation position is provided in the second storage chamber SY2. The developer detection sensor GS is, for example, a piezoelectric sensor or a magnetic permeability sensor. By the detection result by the developer detection sensor GS, it can be ascertained to what height the developer exists from the tank bottom surface 50*c*. In the first embodiment, the developer detection sensor GS (a first sensor 101) is provided at a position before the first flow area 91 as viewed in the circulation direction and overlapping the partition 80 as viewed in the axial direction L.

Next, the relation between the amount of the developer and the position of the first sensor 101 will be described with reference to FIGS. 5A, 5B, and 6.

Figure 5A:
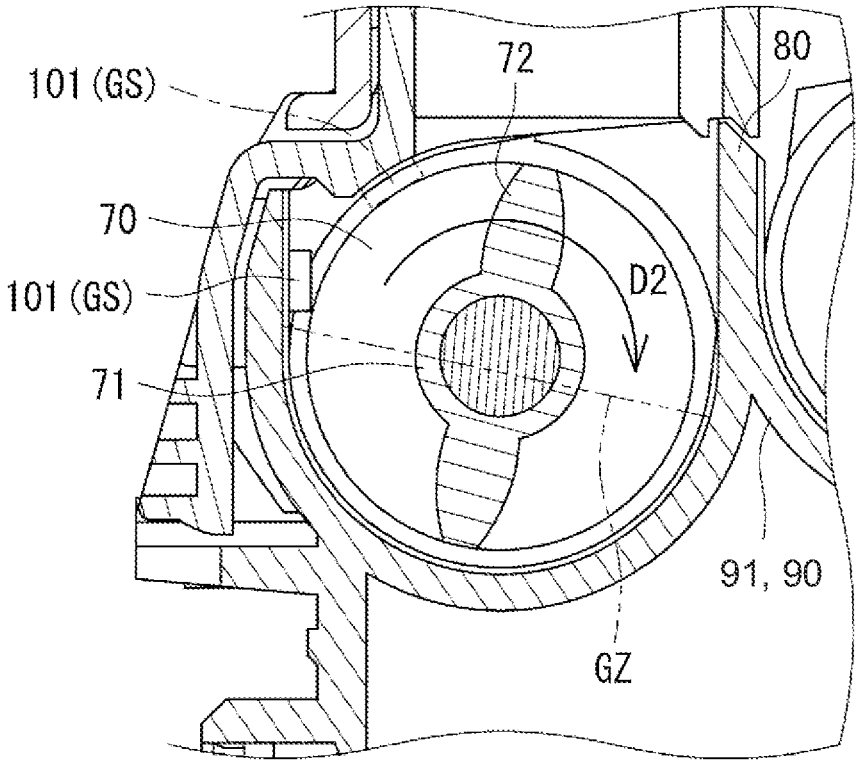
FIG. 5A is an enlarged cross-sectional view near a first sensor with a small developer amount.
Figure 5B:
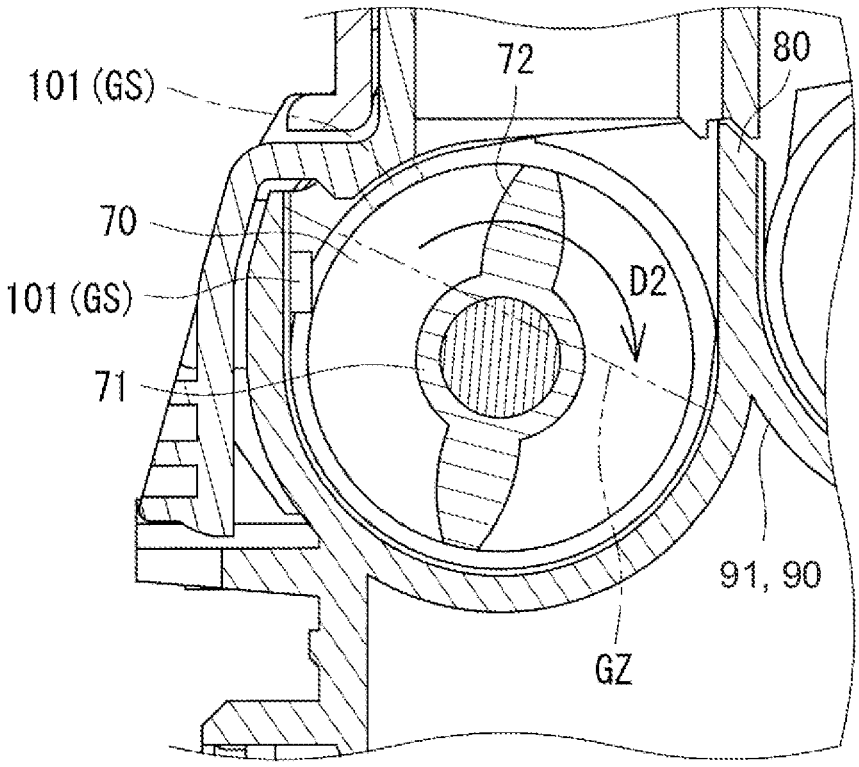
FIG. 5B is an enlarged cross-sectional view near the first sensor with a large developer amount.

FIG. 5A is an enlarged cross-sectional view near the first sensor with a small developer amount, and FIG. 5B is an enlarged cross-sectional view near the first sensor with a large developer amount.

FIGS. 5A and 5B illustrates a cross-section as viewed in a direction perpendicular to the axial direction L, passing through the first sensor 101, and enlarging a part near the second storage chamber SY2. For the installation location of the first sensor 101, the first candidate is indicated by a solid line and the second candidate is indicated by a dotted line. It is sufficient that the first sensor 101 is installed at any one location. For the purpose of explanation, the side of the second storage chamber SY2 that is closer to the partition 80 (on the right side as viewed in FIG. 5A) may be referred to as the inner wall side, and the side that is farther from the partition 80 (on left side as viewed in FIG. 5A) may be referred to as the outer wall side. The first candidate for the installation location of the first sensor 101 is a position on the outer side wall of the second storage chamber SY2 higher than the second shaft 71. The second candidate for the installation location of the first sensor 101 is a position on the top surface of the second storage chamber SY2 closer to the its outer wall.

The double-dotted lines illustrated in FIGS. 5A and 5B indicate the developer surface GZ, and represent that the developer is filled up to the height of the developer surface GZ inside the developer tank 50. When being conveyed by the conveyance member HB, the developer surface GZ is not horizontal and is biased according to the direction of rotation of the conveyance member HB. Specifically, in the second storage chamber SY2, the rotation direction D2 of the second blade 72 is from upward to downward on the inner wall side (clockwise as viewed in FIG. 5A) and from downward to upward on the outer wall side.

In the state with less developer shown in FIG. 5A, the developer surface GZ is inclined so that the outer wall side is slightly higher and the inner wall side is slightly lower. In the state with a large amount of developer shown in FIG. 5*b*, the developer surface GZ is generally high, but the variation on the outer wall side is large, and the height between the outer wall side and the inner wall side differs greatly. That is, regardless of the amount of developer, the developer surface GZ is agitated by the conveyance member HB, and the developer surface GZ tends to be higher on the outer wall side and to fluctuate more on the outer wall side as the amount of developer increases. The first sensor 101 is provided on the outer wall side, and is able to know the variation in amount of the developer in detail by detecting a point where the developer moved up by the helical blades FN gathers when agitated by the conveyance member HB.

Figure 6:
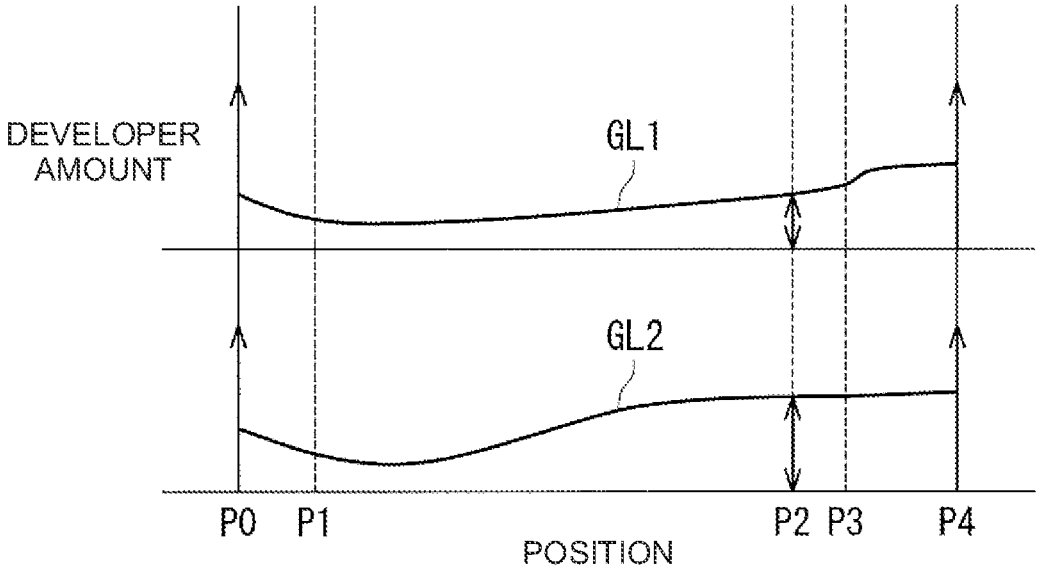
FIG. 6 is an explanatory view illustrating distribution of the developer as viewed in the axial direction.

FIG. 6 is an illustration of the distribution of the developer in the axial direction.

In the developing apparatus 12, there is a bias in the developer surface GZ in the axial direction L, and there is a difference in the variation when the developer increases. The horizontal axis in FIG. 6 indicates a position in the axial direction L, in which the left end "P0" corresponds to the developer tank second end 50*b* and the right end "P4" corresponds to the developer tank first end 50*a*. The vertical axis in FIG. 6 shows the amount of developer (developer amount) and indicates that the amount of developer increases as it moves upward. In other words, at the position where the amount of developer is large, the developer surface GZ is high.

Between "P0" and "P4", there are "P1" and "P3" corresponding to the partition 80, and "P2" corresponding to the first sensor 101. Specifically, "P1" corresponds to an end of the developer tank second end 50*b* side of the partition 80, and "P3" corresponds to an end of the developer tank first end 50*a* side of the partition 80. That is, the area from "P0" to "P1" corresponds to the second flow area 92, and the area from "P3" to "P4" corresponds to the first flow area 91. Furthermore, "P2" indicates the position of the first sensor 101, which is located between "P1" and "P3" and closer to "P3".

In FIG. 6, the first developer amount line GL1 illustrated in the upper part represents the distribution of the developer with the small developer amount illustrated in FIG. 5A, and the second developer amount line GL2 illustrated in the lower part represents the distribution of the developer with the large developer amount illustrated in FIG. 5B. In the first flow area 91 and the second flow area 92, the developer circulating between the first storage chamber SY1 and the second storage chamber SY2 gathers, so that there is no large difference in developer amount between the first developer amount line GL1 and the second developer amount line GL2. Furthermore, considering the change from the first developer amount line GL1 to the second developer amount line GL2 for the portion facing the partition 80, it is found that the developer amount tends to increase on a more down stream side in the circulation direction, and that the variation near "P2" is large. Therefore, by providing the developer detection sensor GS at a point where the variation is large, it is possible to accurately ascertain that the developer tank 50 has become full when the amount of developer in the developer tank 50 increases.

In the developing apparatus 12, when a defective discharge or an excessive supply occurs due to a peculiar method or condition of use, the amount of developer in the developer tank 50 may become larger than necessary, whereby the developing apparatus 12 may reach its capacity. Therefore, the developer detection sensor GS detects that the developer tank 50 is full when the amount of the developer exceeds a predetermined value. When the developer tank 50 is detected to be full, the discharge screw 64 is reversely rotated. Thereby, in the discharge guide 51, the developer is sent toward the discharge port 52. Since the discharge screw 64 is mounted on the first shaft 61 similar to the first blade 62, a reversing action is performed to reversely rotate the first screw 60 itself. During the reversing action, the second screw 70 is also reversely rotated. Thus, by reversely rotating the discharge screw 64 to encourage the discharge of the developer, it is possible to eliminate a state that the developer tank 50 is full.

Second Embodiment

Next, an image forming apparatus (developing apparatus) according to a second embodiment of the present disclosure will be described with reference to the drawings. Since the structure of the image forming apparatus according to the second embodiment is generally the same as that of the first embodiment, similar reference numerals are used and further description thereon is not given.

Figure 7:
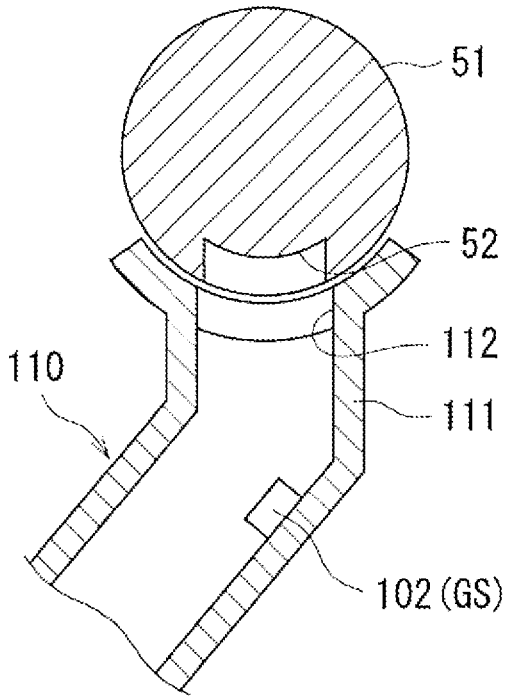
FIG. 7 is a schematic side view near a discharge guide of a developing apparatus according to a second embodiment of the present disclosure.

FIG. 7 is a schematic side view near the discharge guide of the developing apparatus according to the second embodiment of the present disclosure. In FIG. 7, the vicinity of the end of the developing apparatus 12 where the discharge guide 51 is provided is extracted and illustrated schematically, and other portions of the developer tank 50 and a portion supported by the image forming apparatus 1 are omitted.

The developing apparatus 12 has an enclosure 110 to which the developer tank 50 is mounted, and the developer tank 50 is removable from the enclosure 110. The enclosure 110 has an enclosure discharge section 111 connected to the discharge port 52, and the developer detection sensor GS (a second sensor 102) is provided in the enclosure discharge section 111. The enclosure discharge section 111 has an introduction port 112 facing the discharge port 52, and the developer is fed through the introduction port 112. The enclosure discharge section 111 is connected, for example, to an accumulation section (not shown) of the image forming apparatus 1, wherein the discharged developer is accumulated.

The developer detection sensor GS detects the amount of the developer discharged from the discharge port 52, and detects that the developer tank 50 is full when the period that the developer is not discharged is a predetermined time or longer during driving of the conveyance member HB (during a circulation operation). In this way, by carefully observing the developer to be discharged during driving, it is possible to accurately ascertain that the developer tank 50 has become full. In addition, by configuring the developer tank 50 to be removable, it becomes possible to remove and easily replace the developer tank 50. Furthermore, since the developer detection sensor GS is not attached to the developer tank 50 to be replaced, reduction of the number of parts and reduction of cost may be achieved.

Third Embodiment

Next, an image forming apparatus (developing apparatus) according to a third embodiment of the present disclosure will be described with reference to the drawings. Since the structure of the image forming apparatus for the third embodiment is essentially equivalent to that of the first and second embodiments, similar reference numerals are used, and its description and drawing are omitted.

Figure 8:
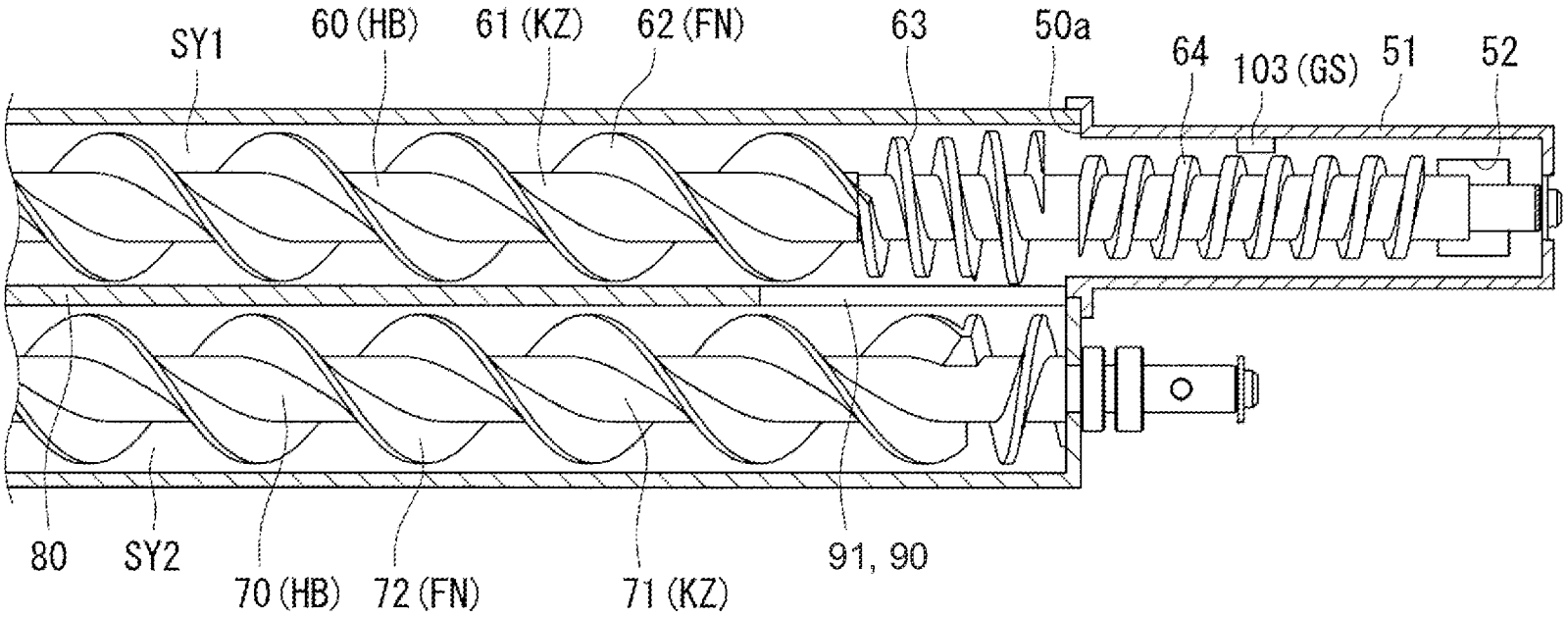
FIG. 8 is a schematic cross-sectional view near a discharge guide of a developing apparatus according to a third embodiment of the present disclosure.

FIG. 8 is a schematic cross-sectional view of a discharge guide near the developing apparatus according to a third embodiment of the present disclosure.

The third embodiment differs from the first embodiment in the position at which the developer detection sensor GS is provided. Specifically, in the third embodiment, the developer detection sensor GS (a third sensor 103) is provided in the discharge guide and detects the amount of the developer discharged from the discharge port 52 according to the amount of the developer in the discharge guide 51. In other words, since the amount of the developer at the discharge guide 51 is in response to the amount of the developer discharged from the discharge port 52, it is possible to know the latter by checking the former.

The presently disclosed embodiments are illustrative in all respects and are not intended to be the basis for a limiting interpretation. Therefore, the technical scope of the present disclosure should not be interpreted only based on the embodiments described above, but is defined based on the description in the scope of the claims, and is intended to include any modifications within the scope and meaning equivalent to the terms of the claims.

What is claimed is:

1. A developing apparatus comprising: a developer tank that contains a developer; and conveyance members that convey the developer while agitating the developer in the developer tank, wherein:

the conveyance members include a first screw and a second screw each having a helical blade provided on a periphery of a rotary shaft, the first screw and the second screw are disposed opposite each other with their rotary shafts being parallel to each other, and rotate to circulate the developer in the developer tank, the developer tank includes:

a first storage chamber in which the first screw is provided;

a second storage chamber in which the second screw is provided;

a partition that separates the first storage chamber from the second storage chamber;

a first flow area and a second flow area provided at respective ends of the first and the second storage chambers, as viewed in an axial direction along the rotary shafts, the first flow area opening the partition to flow the developer from the second storage chamber to the first storage chamber horizontally, the second flow area opening the partition to flow the developer from the first storage chamber to the second storage chamber horizontally;

a developer detection sensor that detects an amount of the developer at an installation position thereof;

a discharge port that discharges the developer; and a discharge guide that guides the developer to the discharge port, wherein a direction in which the developer is circulated in the developer tank is referred to as a circulation direction, the developer detection sensor (i) is positioned on an inner wall of the second storage chamber; between a first end of the partition adjacent to the second flow area and a second end of the partition adjacent to the first flow area, (ii) is adjacent to the second end and, from a side view of the developer tank, is at a position overlapping the partition, and (iii) detects that the developer tank is full according to the amount of the developer.

2. The developing apparatus according to claim 1, wherein the developer detection sensor is provided facing an upstream side as viewed in a rotation direction of the helical blades in a region above the rotary shafts.

3. A developing apparatus comprising: a developer tank that contains a developer; and conveyance members that convey the developer while agitating the developer in the developer tank, wherein the conveyance members include a first screw and a second screw each having a helical blade provided on a periphery of a rotary shaft, the first screw and the second screw are disposed opposite to each other with their rotary shafts being parallel to each other, and rotate to circulate the developer in the developer tank, the developer tank includes:

a first storage chamber in which the first screw is provided;

a second storage chamber in which the second screw is provided;

a partition that separates the first storage chamber from the second storage chamber; and a flow area provided at an end as viewed in an axial direction along the rotary shafts, the flow area opening the partition to flow the developer between the first storage chamber and the second storage chamber;

a developer detection sensor that detects an amount of the developer at an installation position thereof;

a discharge port that discharges the developer; and a discharge guide that guides the developer to the discharge port, wherein a direction in which the developer is circulated in the developer tank is referred to as a circulation direction, the developer detection sensor is provided at a position before the flow area as viewed in the circulation direction and overlapping the partition as viewed in the axial direction, and the developer detection sensor detects that the developer tank is full according to the amount of the developer, the developing apparatus comprises a discharge screw that extends from the first screw or the second screw, and is provided in the discharge guide, the discharge screw feeds the developer in the discharge guide from the discharge port to the first storage chamber or the second storage chamber when the conveyance members are circulating the developer in the circulation direction, and when the developer detection sensor detects that the developer tank is full, the discharge screw is reversely rotated.

4. An image forming apparatus comprising the developing apparatus as claimed in claim 1.

* * * * *